US008896460B2

(12) United States Patent
Alexandrovich et al.

(10) Patent No.: US 8,896,460 B2
(45) Date of Patent: Nov. 25, 2014

(54) LIGHTING CONTROL

(75) Inventors: Benjamin Alexandrovich, Brookline, MA (US); Charles A. Brunault, Hamilton, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 619 days.

(21) Appl. No.: 13/241,538

(22) Filed: Sep. 23, 2011

(65) Prior Publication Data

US 2013/0076270 A1 Mar. 28, 2013

(51) Int. Cl.
*G08B 23/00* (2006.01)

(52) U.S. Cl.
USPC ..... 340/693.2; 340/693.1; 340/693.3; 340/693.4

(58) Field of Classification Search
USPC ..... 340/693.1, 693.2, 693.3, 693.4
See application file for complete search history.

(56) References Cited

U.S. PATENT DOCUMENTS

| | | | | |
|---|---|---|---|---|
| 7,221,106 | B1 * | 5/2007 | Nemir et al. | 315/291 |
| 7,986,111 | B2 * | 7/2011 | Bakre et al. | 315/308 |
| 2005/0093461 | A1 * | 5/2005 | Cull et al. | 315/149 |
| 2006/0097886 | A1 * | 5/2006 | Jones et al. | 340/680 |
| 2006/0158150 | A1 * | 7/2006 | Yen | 320/103 |

* cited by examiner

*Primary Examiner* — Tuyet Thi Vo
(74) *Attorney, Agent, or Firm* — Andrew Martin

(57) ABSTRACT

The present invention provides a lighting fixture including a light source, a light source controller, and an external controller plug. The light source controller controls power to the light source. The external controller plug allows an external controller to selectively engage a power source to the light source controller.

20 Claims, 3 Drawing Sheets

LIGHTING CONTROL

TECHNICAL FIELD

This invention relates to lighting controls and more particularly to a lighting control fixture interface.

BACKGROUND OF THE INVENTION

Remotely controlling multiple light fixtures and intensity of light emitted by the light fixtures has become widespread within the lighting industry. The simplest protocols use a simple on/off switch. Electricity either flows or does not flow through a light bulb. The marriage of computers and lighting has vastly increased the capability to control lighting (for example, scene management) but requires more complex protocols. Traditionally, protocols have been designed to handle two attributes, dimming and addressing. Dimming allows a controller to send an intensity value to a light. Addressing allows the controller to control a particular light or a particular group of lights in a larger number of controlled lights. Together these attributes allow control of traditional white lighting.

There are many existing commercial products providing computer control over lighting, implementing many protocols. There are proprietary protocols that only translate between devices made by one manufacturer (for example, Lightolier® Controls). There are licensable protocols designed to allow devices from many manufacturers to work together (for example X10, Insteon™, Z-wave® and UPB for the home, DMX-512, Lon and DALI for commercial automation).

The protocols operate a variety of controllers that have different physical interfaces that are integrally manufactured with the lighting fixture or hardwired into the lighting fixture. In order to control a particular group of lights, each lighting fixture in the group may be required to have compatible controllers. This may require unnecessary replacing of lighting fixtures for purpose of compatibility and/or a licensed electrician to replace lighting fixtures or hardwire new controllers. Therefore, there is a need to develop a system for more efficient compatibility of controllers and/or replacement of lighting controllers.

SUMMARY OF THE INVENTION

An embodiment of the present invention may be a lighting fixture, systems, or methods thereof. The lighting fixture may include a light source, a light source controller, and an external controller plug. The light source controller controls power to the light source. The external controller plug allows an external controller to selectively engage a power source to the light source controller.

Other embodiments may include one or more of the following variations. The external controller plug can cause a plug switch to disengage a direct connection between the power source and the light source controller. A plug blank can couple the power source to the light source controller when plugged into the external controller plug. The external controller plug includes one or more control signal connections with the light source controller. The external controller plug can include two power input connections, one power return connection, two electronic control gears for the light source controller connections, and one ground connection. The external controller plug can provide plug-and-play capabilities for an external controller. The external controller plug can be positioned within the light fixture to allow an external controller to plug into the external controller plug and be housed within the light fixture. The external controller can provide wireless control and/or supports multiple control protocols.

The present invention is not intended to be limited to a system or method that must satisfy one or more of any stated objects or features of the invention. It is also important to note that the present invention is not limited to the exemplary or primary embodiments described herein. Modifications and substitutions by one of ordinary skill in the art are considered to be within the scope of the present invention.

DETAILED DESCRIPTION OF THE INVENTION

Communication and control functions have become integral parts of lighting technology. The low cost of the controller components have made integration of individual light source controller units commonplace in lighting fixtures. The light source controllers are tied into communication networks using different communication technologies. Development and modification of the networks require flexibility in installation and replacement of the control devices. Presently, attaching the control devices to the existing light fixture may require new and additional power supply wiring. This makes control installation and maintenance expensive, calling for participation of certified or licensed electricians.

Embodiments of the present invention may provide a physical interface or a plug between a lighting source of the lighting fixture and the light source controller, which allows the lighting fixture to be "control-ready", i.e. any new control device or external controller can be plugged into it. This interface or plug can be incorporated in the design of new fixtures and/or provide for modification of existing fixtures. Lighting fixture as used herein can include, for example, but not limited to, free-standing lighting, recessed lighting, surface mounted lighting, outdoor lighting, and/or portable lighting. Lighting source as used herein may include but is not limited to incandescent, halogen, fluorescence, and LED.

Figure 1:
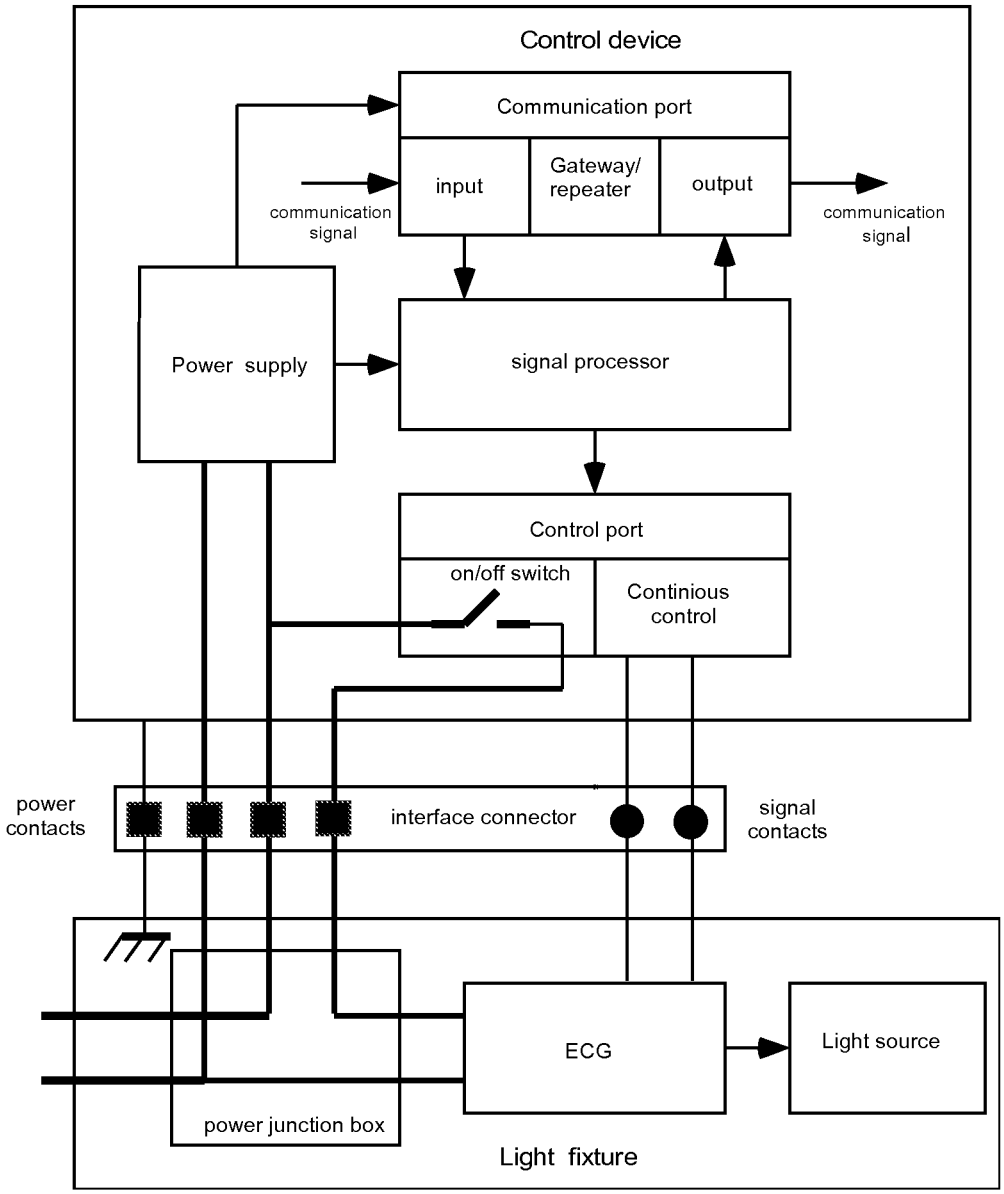
FIG. 1 is a block diagram of a lighting fixture with an external controller plug according to an exemplary embodiment of the invention.

Referring to FIG. 1, a light source controller couples a power source to a light source through a plug interface according to an exemplary embodiment of the invention. The light fixture includes a light source with an ECG (ballast) coupling external power at a power junction box to the light source. The light fixture incorporates an external controller plug that can control the supply of power from the junction box to the ECG and/or light source. The external controller plug provides an interface for plugging an external controller with an external controller plug into the light fixture.

During operation, when the external controller is not plugged into the external controller plug, the light fixture may operate in a traditional manner via a wall switch or internal controller. An individual may operate the light source in a traditional manner by flipping the light switch or other control device that communicates with the internal controller. During operation, when the external controller is plugged into the external controller plug, the light fixture may also operate via the external controller or a control device in communication with the external controller.

The external controller can include a signal processor, communication port, and/or a control port. The communication port provides communication with other control and processing devices via wired or wireless communications. Communication may include both in-coming and out-going communications via various communications protocols. Example of communication protocols include but are not limited to X10, Digital Addressable Lighting Interface (DALI), DMX512 (For "Digital Multiplex with 512 pieces of information"), Lonworks, Dynalite, Modbus, C-Bus, KNX, MIDI, INSTEON, Vantage Controls, and Z-wave. The communication port can pass the communication to a signal processor which may execute instructions and activate a control port. The control port can control the light source by removing or altering power supplied to the ECG via the external controller plug. In other embodiments, the control port can also control the light source by transmitting control signals directly to the ECG and/or internal controller to control the light source via the ECG and/or internal controller. Power supplied to the external controller can be supplied from the power source via the external plug and/or internal battery (not shown) or other power source. The external controller is not limited to the above components or configurations, for example, various components can be incorporated together, included or omitted.

The external controller plug includes the coupling of various electrical contacts. Examples of electrical contacts may include one or more power inputs, one or more power returns, one or more internal ECG or controller signal paths, and one or more ground connections. In the embodiment shown in FIG. 1, the external controller plug includes (from left to right), one ground connection, a power input, a power return, a power input light source input, and two internal ECG or control signal paths.

The plug interface can be positioned within the light fixture to provide easy access for plugging in the external controller plug without removal of the light fixture. According to one embodiment, the plug interface may be within the cavity housing of the light fixture that allows for changing and maintenance of the lamp of the light source. Such embodiment may allow an individual to easily access the plug interface within the fixture and plug the external controller plug into the plug interface. The external controller plug can be plugged into and stored during use completely within the light fixture housing. Embodiments are not limited to storage within the light fixture housing. An alternative embodiment can include the plug interface on an exterior surface of the light fixture. According to this embodiment, an individual may access the plug interface to couple the external controller to the plug interface by access through, for example, drop ceiling. The user may access a drop ceiling panel adjacent the light fixture. The user may then plug the external controller into the plug interface located on a side or top surface of the light fixture located within the drop ceiling.

Embodiments of the invention are not limited to incorporation only in light fixtures and can be incorporated into other housings or junctions that control power supply to the ECG of the light fixture.

Figure 2:
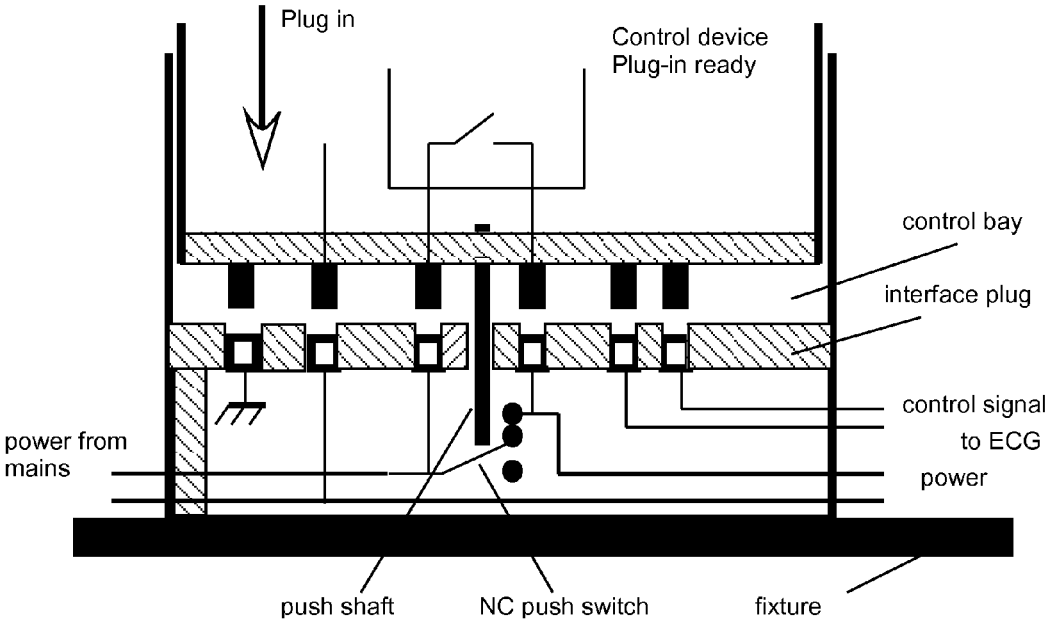
FIG. 2 is a cross-sectional diagram of a lighting fixture with an external controller plug switch according to an exemplary embodiment of the invention.

Referring to FIG. 2, the external controller plug can also incorporate a switch to selectively engage and disengage power supplied to the ECG. In the embodiment shown in FIG. 2, plugging the external controller into the external controller plug causes a shaft to activate the switch and disconnect the power from the power source directly to the ECG or internal controller. Once the external controller is plugged in, power is directed to the external control and then to the ECG or internal controller via the external controller. The power supplied to the ECG or internal controller can be controlled by the external controller selectively controlling or altering the power supplied to the ECG or internal controller. If the external controller plug is subsequently removed, the switch reconnects to power from the power source directly to the ECG or internal controller allowing the light fixture to operate in its traditional manner.

Figure 3:
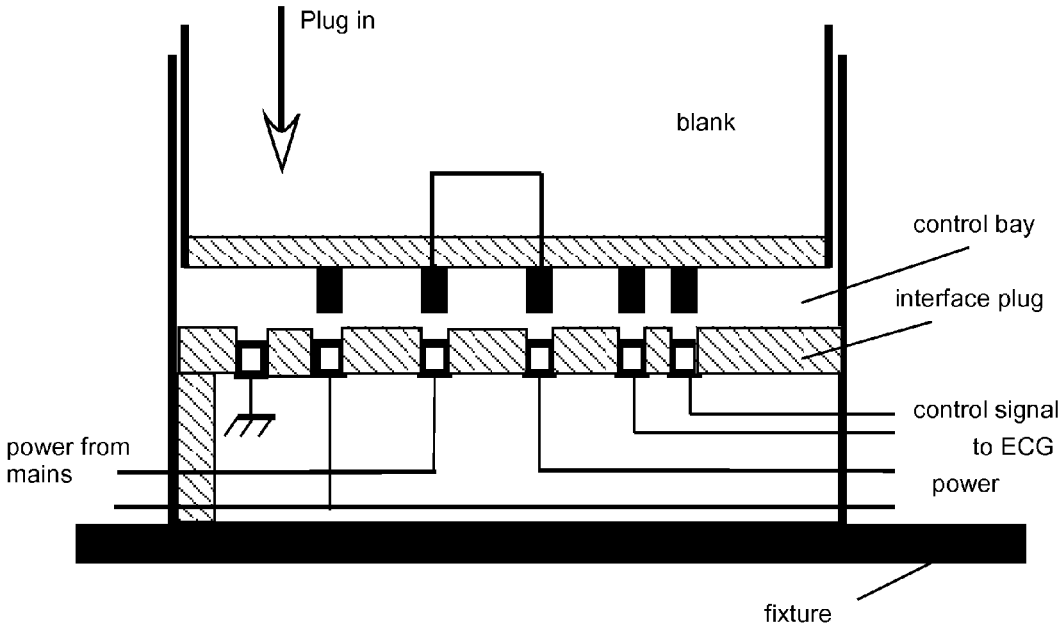
FIG. 3 is a cross-sectional diagram of a lighting fixture with an external controller plug and plug blank according to an exemplary embodiment of the invention.

Referring to FIG. 3, a plug blank with a jumper can be used to allow the light fixture to operate in a traditional manner according to an exemplary embodiment of the invention. With the plug blank plugged into the external controller, the jumper supplies power from the power source directly to the ECG or internal controller allowing the switch to operate in its traditional manner. When the plug blank is removed and the external controller is plugged in, power is directed to the external control and then to the ECG or internal controller. The powered supplied to the ECG or internal controller can then be controlled by the external controller selectively controlling or altering the power supplied to the ECG or internal controller. If the plug blank is subsequently replaced, the jumper reconnects to power from the power source directly to the ECG or internal controller allowing the light fixture to operate in its traditional manner. The jumper described is not limited to being used in the plug blank and can be used at various junctions in the light fixture to facilitate redirection of electrical contacts to the external controller plug. Other forms of intelligent jumpers can be used to sense connection of an external control and remove or redirect electrical connections within the light fixture.

Embodiments of the invention are not limited to an external controller plug interface described above. Embodiments may provide a universal interface that can accommodate various external controllers and/or adapters to external controllers. Embodiments can facilitate updating or retrofitting current lighting controls by uncertified electrical or communication technicians. Embodiments of the invention may provide a control ready retrofit kit that can be used to provide current non-control ready or outdated light fixtures with the ability to be control ready or have updated controls.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of this invention are presented for purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications. These procedures will enable others, skilled in the art, to best utilize the invention and various embodiments with various modifications. It is intended that the scope of the invention be defined by the following claims and their equivalents. Modifications and substitutions by one of ordinary skill in the art are considered to be within the scope of the present invention, which is not to be limited except by the following claims.

While there have been shown and described what are at present considered to be the preferred embodiments of the invention, it will be apparent to those skilled in the art that various changes and modifications can be made herein without departing from the scope of the invention as defined by the appended claims.

We claim:

1. A lighting fixture comprising:

a light source;

a light source controller for controlling power to the light source; and an external controller plug wherein the plug allows an external controller to selectively engage a power source to the light source controller.

2. A lighting fixture of claim 1, further comprises:

a plug switch of the external controller plug wherein connecting a plug interface with the external controller plug causes the plug switch to disengage a direct connection between the power source and the light source controller.

3. A lighting fixture of claim 1, further comprises:

an external controller plug blank wherein the plug blank couples the power source to the light source controller when plugged into the external controller plug.

4. A lighting fixture of claim 1, wherein the external controller plug includes one or more control signal connections with the light source controller.

5. A lighting fixture of claim 1, wherein the external controller plug has two power input connections, one power return connection, two electronic control gear for the light source controller connections, and one ground connection.

6. A lighting fixture of claim 1, wherein the external controller plug provides plug-and-play capabilities for an external controller.

7. A lighting fixture of claim 1, wherein the external controller plug is positioned within the light fixture to allow an external controller to plug into the external controller plug and be housed within the light fixture.

8. A lighting fixture of claim 1, further comprising an external controller plugged into the external controller plug and the external controller provides wireless control.

9. A lighting fixture of claim 1, further comprising an external controller plugged into the external controller plug and the external controller supports multiple control protocols.

10. A method of controlling a lighting fixture comprising the action of:

controlling power to a light source with an internal light source controller;

plugging an external controller into an external controller plug of the light fixture; and selectively engaging a power source to the light source controller with the external controller.

11. A method of controlling a lighting fixture of claim 10, further comprises the action of:

connecting a plug interface with the external controller plug causing a plug switch to disengage a direct connection between the power source and the light source controller.

12. A method of controlling a lighting fixture of claim 10, further comprises the action of:

plugging in an external controller plug blank into the external controller plug couples the power source to the light source controller.

13. A method of controlling a lighting fixture of claim 10, wherein plugging the external controller into the external controller plug couples one or more control signal connections with the light source controller.

14. A method of controlling a lighting fixture of claim 10, wherein plugging the external controller into the external controller plug couples two power input connections, one power return connection, two electronic control gear for the light source controller connections, and one ground connection.

15. A method of controlling a lighting fixture of claim 10, further comprises the action of:

providing plug-and-play capabilities for an external controller when the external controller is plugged into the external controller plug.

16. A method of controlling a lighting fixture of claim 10, wherein plugging an external controller into the external controller plug is accessed from within the light fixture.

17. A method of controlling a lighting fixture of claim 10, further comprising the action of:

controlling the external controller wirelessly.

18. A method of controlling a lighting fixture of claim 10, wherein the external controller supports multiple control protocols.

19. A lighting fixture comprising:

a light source;

a light source controller for controlling power to the light source;

an external controller plug wherein the plug allows an external controller to physically disengage a power source to the light source controller and includes one or more control signal connections with the light source controller; and the external controller plugged into the external controller plug wherein the external controller supports multiple lighting control protocols.

20. A lighting fixture of claim 19, wherein the external controller plug is positioned within the light fixture to allow an external controller to plug into the external controller plug and be housed within the light fixture.

* * * * *